United States Patent [19]

Tottori

[11] 3,991,342

[45] Nov. 9, 1976

[54] AC DRIVE DISCHARGE TYPE DISPLAY APPARATUS

[75] Inventor: Hiroshi Tottori, Amagasaki, Japan

[73] Assignee: Mitsubishi Denki Kabushiki Kaisha, Tokyo, Japan

[22] Filed: Oct. 15, 1974

[21] Appl. No.: 514,781

[30] Foreign Application Priority Data

Oct. 16, 1973 Japan ..... 48-116193

[52] U.S. Cl. ..... 315/169 TV; 315/169 R

[51] Int. Cl.[2] ..... H05B 37/00

[58] Field of Search ..... 315/169 TV, 169 R

[56] References Cited

UNITED STATES PATENTS 3,852,609 12/1974 Peters ..... 315/169 TV

*Primary Examiner*—R. V. Rolinec
*Assistant Examiner*—Lawrence J. Dahl
*Attorney, Agent, or Firm*—Oblon, Fisher, Spivak, McClelland & Maier

[57] ABSTRACT

An AC drive discharge type display apparatus which includes a display panel having groups of transverse electrodes and vertical electrodes which are positioned in cross form with a gap therebetween and having cross points which are made luminescent by applying an AC sustaining drive voltage, a turn-on signal and a turn-off signal. A drive circuit is further provided and has transistors and resistances which are connected at one end to the collector electrode of the transistor and the other end of the resistor being disposed in a matrix; means for commonly connecting said other ends of the resistors in each transverse line of the matrix; a first selective switch circuit for applying the turn-on signal or the turn-off signal by selectively driving the transverse lines which are commonly connected; means for commonly connecting the bases and emitters of the transistors in a vertical line of the matrix; means for connecting each of the bases and emitters which are commonly connected, through a diode to the sustaining drive voltage source; a second selective switch circuit for selectively driving the vertical lines by connecting the same to the bases or emitters which are commonly connected; and wherein the collectors of the transistors of the drive circuit are connected to the electrodes in one or both of the groups of the electrodes in the transverse or vertical direction of the display panel.

2 Claims, 10 Drawing Figures

FIG.1a
PRIOR ART
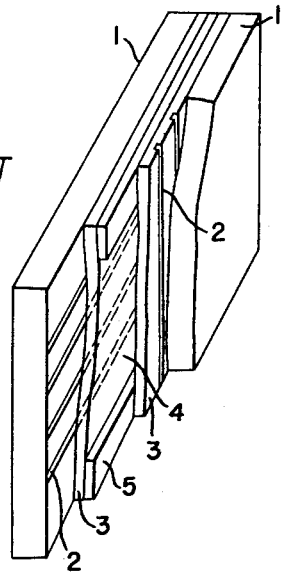
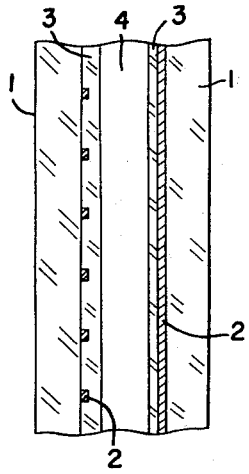
FIG.1b
PRIOR ART
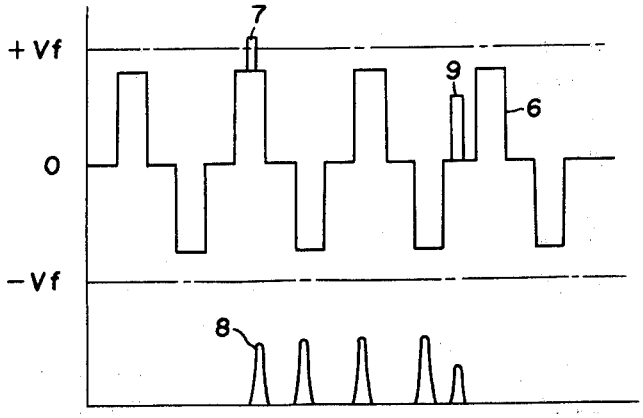
FIG.2a
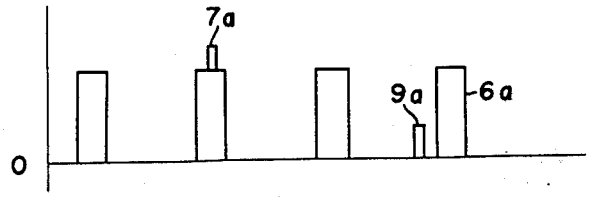
FIG.2b
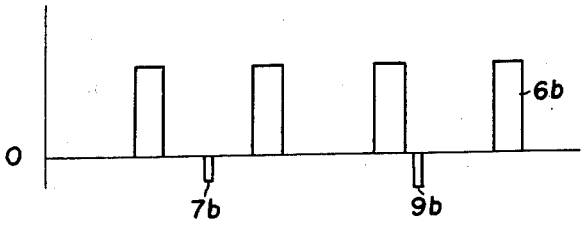
FIG.2c

AC DRIVE DISCHARGE TYPE DISPLAY APPARATUS

BACKGROUND OF THE INVENTION

1. Field of the Invention

The present invention relates in general to an AC drive discharge type display apparatus and more particularly to an AC drive discharge type display apparatus having a drive circuit for applying a sustaining drive voltage, a turn-on pulse and a turn-off pulse to a matrix type display panel.

2. Description of the Prior Art

FIGS. 1*a and 1b* are respectively a partially broken schematic view of one embodiment of a display panel used for a conventional AC drive discharge type display apparatus, wherein the reference 1 designates a glass plate; 2 designates linear electrodes; 3 designates an insulation layer, 4 designates a discharge gap; and 5 designates a spacer.

In the display panel, the two sheets of glass plates 1 having the plurality of linear electrodes 2 on which the insulation layer 3 is placed, are formed with the discharge gap of fixed length by the spacer 5 so as to cross the linear electrodes 2 of each sheet.

The cross points of the linear electrodes 2 of the display panel are respectively luminescent dots which can be separately turned-on or turned-off. The luminescent dots provide the picture elements for display.

In the drawings, like reference numerals designate identical or corresponding parts throughout the several views. FIGS. 2*a*–2*c* are diagrams of waveforms for illustrating the various states of voltage application during the time of driving of the discharge panel, wherein the reference numeral 6 designates a sustaining drive voltage; 7 designates a turn-on pulse; 8 designates a luminescent pulse; and 9 designates a turn-off pulse. The operation of the display panel of FIGS. 1*a* and 1*b* will be explained by referring to FIGS. 2*a*–2*c*.

In order to drive the display panel, the AC sustaining drive voltage 6 of FIG. 2*a* is applied, in a normal state, across the discharge gap 4 through the two groups of the linear electrodes 2. The turn-on pulse 7 which has a level higher than the discharge initiation voltage $V_f$ is applied between the two linear electrodes 2 crossed at the turn-on point at the time of turn-on, whereby a discharge results only at the cross point. Once the discharge occurs, the luminescence is intermittently maintained until the turn-off pulse 9 of FIG. 2*a* is applied. Hereinafter, one group of the linear electrodes 2 in the two groups is referred to as X electrodes (X drive lines) and the other group is referred as Y electrodes (Y drive lines).

In order to apply the voltages of FIG. 2*a*, i.e. the sustaining drive voltage 6, the turn-on pulse 7 and the turn-off pulse 9 across the discharge gap 4, the voltage of FIG. 2*b* which is the sustaining drive voltage 6*a*, the turn-on pulse 7*a* and the turn-off pulse 9a is applied to the X electrodes and the voltage of FIG. 2*c* which is the sustaining drive voltage of FIG. 2c which is the sustaining drive voltage 6*b*, the turn-on pulse 7*b* and the turn-off pulse 9*b* is applied to the Y electrodes.

Incidentally, the turn-on pulses 7*a* and 7*b* respectively have a level of one-half of that of the turn-on pulse 7, and have reverse polarities to each other. The turn-off pulses 9*a* and 9*b* respectively have a level of one-half of that of the turn-off pulse 9 and have reverse polarities to each other.

FIG. 3 is a diagram illustrating one embodiment of the drive circuit for the display panel of the conventional AC drive discharge type display apparatus, wherein $V_s$ designates a sustaining drive voltage terminal; $V_p$ designates a turn-on voltage terminal; $S_{ai}$ ($i$ = 1,2,3) $S_{bj}$ ($j$ = 1,2,3) designate selective switch circuits; and $E_{ij}$ ($i,j$ = 1,2,3) designate output terminals. The drive circuit is a matrix type circuit wherein AND circuits are formed by the resistances and the diodes.

In FIG. 3, nine lines of the linear electrodes 2 (FIGS. 1*a* and 1*b*) are given as the X electrodes of the display panel, and accordingly each linear electrode is connected through the respective output terminal $E_{ij}$ to three elements which consists of two diodes $D_a$, $D_b$ and a resistance $R_a$.

In the drive circuit, the sustaining drive voltage 6 having the waveform of FIG. 2*b*, is applied as an input to the sustaining drive voltage terminal $V_s$, and is passed through the diode $D_a$ to the output terminal $E_{ij}$ for the X electrode at the charge up time and is then passed at the discharge time through the diode $D_b$ and a selective switch circuit $S_{bj}$ of a switch element, e.g. a transistor which is usually in the ON state, to the sustaining drive voltage terminal $V_s$.

Incidentally, the selective switch circuit $S_{ai}$ is usually in the OFF state. In order to apply the turn-on pulse shown in FIG. 2*b*, one switch of the first selective switch circuit $S_{ai}$ which is connected to the turn-on voltage terminal $V_p$, is turned on and one switch of the second selective switch circuit $S_{bj}$ is turned off, whereby the turn-on pulse 7a is applied through one terminal of the output terminal $E_{ij}$ to one linear electrode 2 of the X electrodes of the display panel. For example, when the turn-on pulse 7*a* is applied to the X electrodes which are connected to the output terminals $E_{22}$, the switch $S_{a2}$ is turned on and the switch $S_{b2}$ is turned off, whereby the current is passed through the three transverse resistances $R_a$ which are connected to the switch $S_{a2}$. However, since the switches $S_{b1}$ are in the ON state, the current passing through the vertical lines is passed through the diodes $D_b$ and the switches $S_{b1}$, $S_{b3}$ to the sustaining drive voltage terminal $V_s$. The voltage of the output terminals $E_{21}$, $E_{23}$ is kept at the same level as that of the terminal $V_s$ by the voltage drop in the resistance $R_a$ and accordingly the turn-on pulse 7*a* is not applied to the X electrodes which are connected to the output terminals $E_{21}$, $E_{23}$ and accordingly the turn-on pulse 7*a* is applied only to the X electrode which is connected to the output terminal $E_{22}$ in the line of the switch $S_{b2}$ which is in the OFF state. The selectivity is determined by the characteristic of the AND circuits which consist of the resistance and the diodes. The turn-off pulse 9*a* (FIG. 2*b*) can also be applied separately to each of the linear electrodes of the X electrodes in a manner similar to that of the turn-on pulse 7*a*.

Certain problems exist with the conventional drive circuit for the display panel using the AND circuit system of the resistance and the diode in that disadvantageously a large consumption of power is required, since unnecessary current is passed through the resistance $R_a$ to the circuit connected to the linear electrodes 2 to which the turn-on pulse and the turn-off pulse are not applied. Moreover, the conventional drive circuit also disadvantageously requires three circuit elements, namely two diodes $D_a$, $D_b$ and one resistance $R_a$, for each linear electrode 2, and accordingly the number of circuit elements is large.

SUMMARY OF THE INVENTION

Accordingly, it is an object of the present invention to provide a new and improved unique AC drive discharge type display apparatus which overcomes the disadvantages of the conventional technology and which decreases the number of circuit elements of the drive circuit and decreases consumption power.

Briefly, in accordance with the present invention, the foregoing and other objects are attained by providing an AC drive discharge type display apparatus which includes a display panel having groups of transverse electrodes and vertical electrodes which are positioned in cross form with a gap therebetween having cross points which are made luminescent by applying an AC sustaining drive voltage, a turn-on signal and a turn-off signal. A drive circuit is further provided and has transistors and resistances which are connected at one end to the collector electrode of the transistor and the other end of the resistor being disposed in a matrix; means for commonly connecting said other ends of the resistors in each transverse line of the matrix; a first selective switch circuit for applying the turn-on signal or the turn-off signal by selectively driving the transverse lines which are commonly connected; means for commonly connecting the bases and emitters of the transistors in a vertical line of the matrix; means for connecting each of the bases and emitters which are commonly connected, through a diode to the sustaining drive voltage source; a second selective switch circuit for selectively driving the vertical lines by connecting the same to the bases or emitters which are commonly connected; and wherein the collectors of the transistors of the drive circuit are connected to the electrodes in one or both of the groups of the electrodes in the transverse or vertical direction of the display panel.

BRIEF DESCRIPTION OF THE DRAWINGS

A more complete appreciation of the invention will become apparent as the same becomes better understood by reference to the following detailed description when considered in connection with the accompanying drawings wherein:

FIGS. 1*a* and 1*b* are respectively a partially broken schematic view and a sectional view of one embodiment of a display panel of the conventional AC drive discharge type display apparatus;

FIGS. 2*a*, 2*b* and 2*c* are waveforms for illustrating the application of voltage to the display panel of FIGS. 1*a* and 1*b;*

DETAILED DESCRIPTION OF THE PREFERRED EMBODIMENTS

Figure 3:
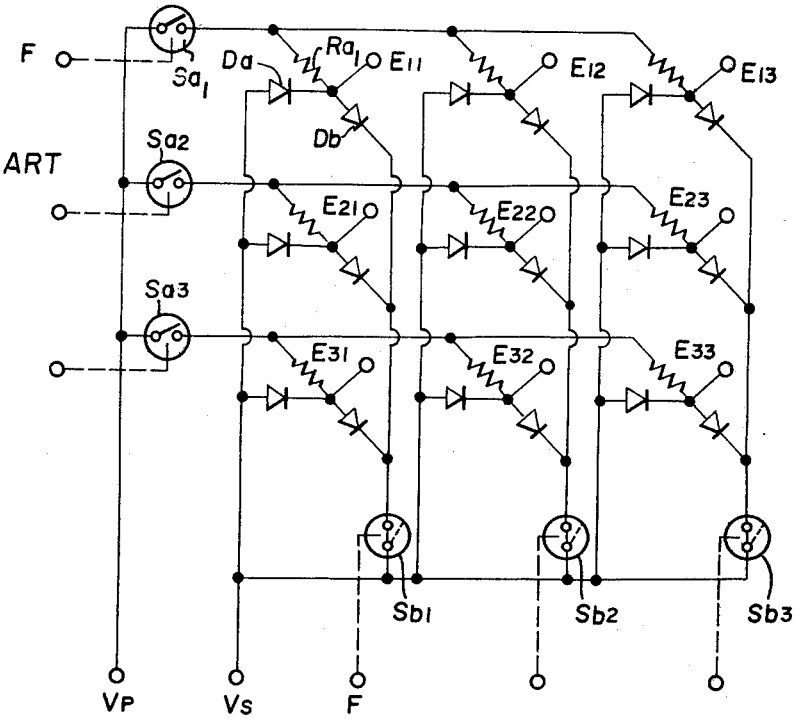
FIG. 3 PRIOR ART
FIG. 3 is a circuit diagram for illustrating the drive circuit for the display panel of the conventional AC drive discharge type display apparatus.

Referring now to the drawings, preferred embodiments of the invention will be illustrated.

Figure 4:
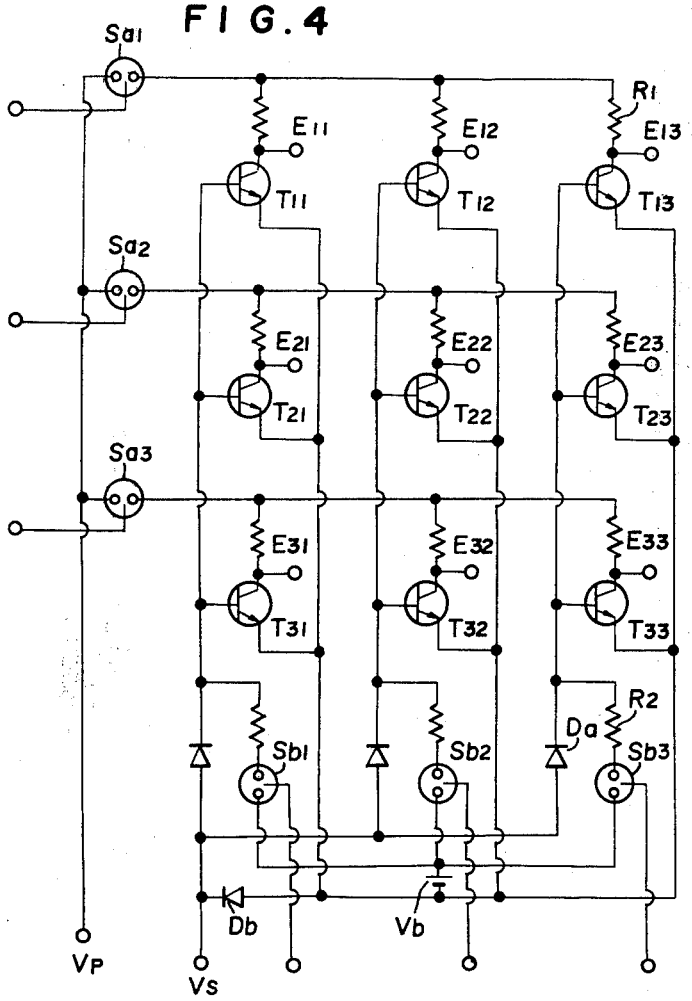
FIGS. 4, 5 and 6 are respectively circuit diagrams for showing preferred embodiments of display panel drive circuits of the AC drive discharge type display apparatus of the present invention.

FIG. 4 is a circuit diagram of one preferred embodiment of a display panel drive circuit of an AC drive discharge type display apparatus according to the present invention wherein $T_{ij}$ (= 1,2,3) ($j$ = 1,2,3) designates a transistor; $R_1$ and $R_2$ designate resistances; $D_a$ and $D_b$ designate diodes and $V_b$ designates a bias power source. The drive circuit shown can be used for the X electrodes of the nine linear electrodes 2 (FIGS. 1*a* and 1*b*) of the display panel.

The structure of the circuit will be now described as follows. The drive circuit is formed in a matrix using a plurality of the unit circuits each of which consists of one transistor $T_{ij}$ and one resistance $R_1$ wherein the collector electrode of the transistor $T_{ij}$ in each unit circuit is connected to one end of the resistance $R_1$ of the unit circuit and the output terminal $E_{ij}$ ($i$ = 1,2,3; $j$ = 1,2,3) to the X electrodes of display panel. The other end of the resistances $R_1$ of the unit circuits in the transverse line of the matrix are commonly connected to one transverse line which is connected to a first selective switch circuit $S_{ai}$ which is connected to a turn-on voltage terminal $V_p$.

On the other hand, the base electrodes of the transistors $T_{ij}$ of the unit circuits in the vertical line of the matrix are commonly connected to one vertical line, each of which is connected to a diode $D_a$. The diode $D_a$ is connected in the forward direction of the base-emitter junctions of the transistors $T_{ij}$ and to the sustaining drive voltage terminal $V_s$. The vertical line is also connected through the resistance $R_2$ to a second selective switch circuit $S_{bj}$ for selecting the vertical lines of the matrix. The emitter electrodes of the transistor $T_{ij}$ are connected to another vertical line which is connected through a common diode $D_b$. The common diode $D_b$ is connected in the forward direction of the base emitter junctions of the transistors $T_{ij}$ and to the sustaining drive voltage terminal $V_s$. The vertical line is also connected through the common bias power source $V_b$ to the second selective switch circuit $S_{bj}$. Incidentally, the bias power source $V_b$ is connected in the forward direction of the base-emitter junctions of the transistors $T_{ij}$.

The operation of the drive circuit will now be described as follows. The first selective switch circuit $S_{ai}$ is usually in the OFF state and the second selective switch circuit $S_{bj}$ is usually in the ON state. In these states the sustaining drive voltage 6*a* (FIG. 2*b*) is applied as an input to the sustaining drive voltage terminal $V_s$. When the positve voltage $V_s$ is applied to the terminal $V_s$, the positive voltage $V_s$ is applied through the diode $D_a$ to the base electrode of the transistors $T_{ij}$ since the bias voltage is therefore applied between the base-collector of the transistors in the direction from the base to the collector and the transistors are NPN type, whereby the positive voltage $V_s$ which is substantially equal to the base voltage is applied to the collector electrode of the transistor $T_{ij}$, that is connected to the output terminal $E_{ij}$, of the X electrodes of the display panel. When the terminal $V_s$ becomes a zero voltage, since the selective switch circuit $S_{bj}$ is in the ON state, the bias voltage is applied through the resistance $R_2$ between the base-emitter of the transistors $T_{ij}$ by the bias power source in the forward direction to the base emitter junction, whereby the transistor $T_{ij}$ is in the ON state. Accordingly, the positive voltage $V_s$ which is substantially equal to the base voltage is applied to the output terminal $E_{ij}$ of the X electrodes of the display panel, that is the collector electrode of the transistor $T_{ij}$. When the terminal $V_s$ becomes a zero voltage, the switch circuit $S_{bj}$ is in the ON state and the transistor $T_{ij}$ is in the ON state.

On the other hand, the emitter electrode of the transistors $T_{ij}$ is connected through the diode $D_b$ which is connected in the forward direction to the sustaining drive voltage terminal $V_s$, whereby the voltage at the output terminals $E_{ij}$ is substantially equal to the voltage at the terminal $V_s$ that is the zero voltage.

Thus, a drive waveform having an amplitude substantially equal and level to that of the sustaining drive voltage $6_a$ applied to the terminal $V_s$ is applied to the output terminal, that is the X electrodes of the display panel which are connected to the collector electrodes of the transistors $T_{ij}$, when the first selective switch circuit $S_{ai}$ is in the OFF state and the second selective switch circuit $S_{bj}$ is in the ON state and the sustaining drive voltage $6_a$ (FIG. 2*b*) is applied to the sustaining drive voltage terminal $V_s$.

The operation of applying the turn-on pulse $7_a$ to only the output terminal $E_{22}$ will now be explained. In this case, the turn-on pulse voltage $7_a$ is applied to the turn-on voltage terminal $V_p$ and the switches $S_{a1}$, $S_{a3}$ and the switch $S_{b2}$ are in the OFF state and the switch $S_{a2}$ and the switches $S_{b1}$ and $S_{b3}$ are in the ON state, whereby the current resulting from the turn-on pulse voltage is passed through the switch $S_{a2}$ in the ON state and the resistance $R_1$ to the transistors $T_{ij}$.

On the other hand, the switches $S_{b1}$, $S_{b3}$ are in the ON state, whereby the transistors $T_{i1}$ and $T_{i3}$ are in the ON state by passing a bias current resulting from the bias voltage $V_b$ between the base-emitter electrodes of the transistors $T_{i1}$, $T_{i3}$ in the vertical lines of the switches $S_{b1}$, $S_{b3}$. Accordingly, the current passing through the resistance $R_1$ to the transistors $T_{21}$, $T_{23}$, is passed out through the transistors $T_{21}$, $T_{23}$ and the diode $D_b$ to the sustaining drive voltage terminal $V_s$, whereby the turn-on pulse voltage is not applied to the output terminals $E_{21}$, $E_{23}$ by the voltage drop in the resistance $R_1$.

Thus, the transistor $T_{i2}$ in the line of the switch $S_{b2}$ is in the OFF state, since the base current is not passed. Accordingly, the turn-on pulse voltage is applied to the output terminal $E_{22}$, whereby the turn-on pulse voltage $7_a$ is applied to only the output terminal $E_{22}$.

In the same manner it is possible to apply the turn-on pulse $7_a$ to any desirable output terminal $E_{ij}$ by selectively driving the first selective switch circuit $S_{ai}$ and the second selective switch circuit $S_{bj}$. The operation of applying the turn-off pulse $9_a$ is the same as the case applying the turn-on pulse $7_a$. In this case, the turn-off pulse $9_a$ (FIG. 2*b*) is applied to the turn-on voltage terminal $V_p$.

Figure 5:
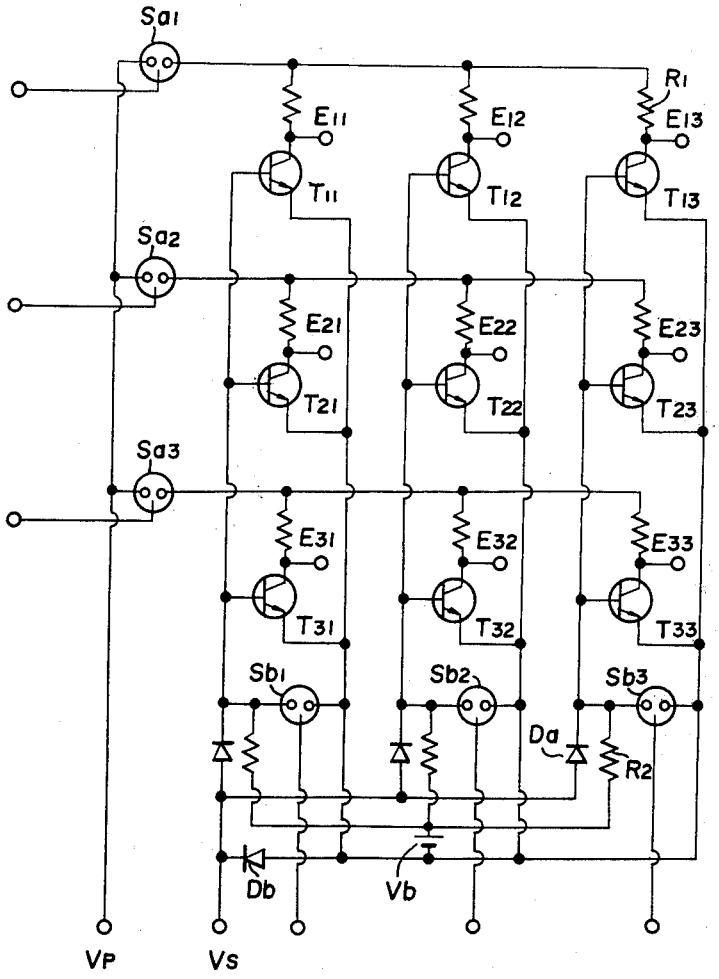

FIG. 5 is a circuit diagram of another preferred embodiment of the display panel drive circuit of the AC drive discharge type display apparatus of the present invention. In this circuit, the second selective switch circuit $S_{bj}$ for selecting the vertical lines of the matrix is connected between the base-emitter electrode of the transistors $T_{ij}$. The operation of the drive circuit according to this embodiment will now be described as follows. In this circuit, the first selective switch circuit and the second selective switch circuit are usually in the OFF state, and the bias voltage is usually applied by the bias power source $V_b$, through the resistance $R_2$ between the base-emitter electrodes of the transistor $T_{ij}$ in the forward direction to the base-emitter junction.

Accordingly, the operation of applying the sustaining drive voltage $6_a$ (FIG. 2*b*) is similar to the embodiment of FIG. 4 and a drive waveform having an amplitude substantially equal and level to those of the sustaining drive voltage $6_a$ applied to the sustaining drive voltage terminal $V_s$, is applied to the output terminal $E_{ij}$.

The operation of applying the turn-on pulse $7_a$ to only the output terminal $E_{22}$ will be now described like that of FIG. 4. In this case, in a manner similar to the embodiment of FIG. 4, only the switch $S_{a2}$ of the first selective switch circuit $S_{ai}$ is in the ON state, and the collector electrode of the transistor $T_{2i}$ in the transverse line is connected through the resistance $R_1$ to the turn-on voltage terminal $V_p$. On the other hand, in the second selective switch circuit $S_{bj}$, only switch $S_{b2}$ is in the ON state, and the base-emitter electrodes of the transistors $T_{i2}$ in the vertical line are connected in short-circuit, and the transistor $T_{12}$ is in the OFF state, since the base current is prevented from passing to the transistor $T_{i2}$.

During this time period, the transistors $T_{i1}$ and $T_{i3}$ in the other vertical line are in the ON state by applying the bias voltage by the bias power source $V_b$ in the forward direction of the base-emitter junction since the switches $S_{b1}$ and $S_{b3}$ are in the OFF state.

Accordingly, similar to the embodiment of FIG. 4, the turn-on pulse voltage $7_a$ is applied to only the output terminal $E_{22}$. Thus, in the same manner, it is possible to apply the turn-on pulse $7_a$ to a desirable terminal $E_{ij}$ by selectively driving the first selective switch circuit $S_{ai}$ and the second selective switch circuit $S_{bj}$. The operation of applying the turn-off pulse $9a$ is similar to that of the turn-on pulse.

Figure 6:
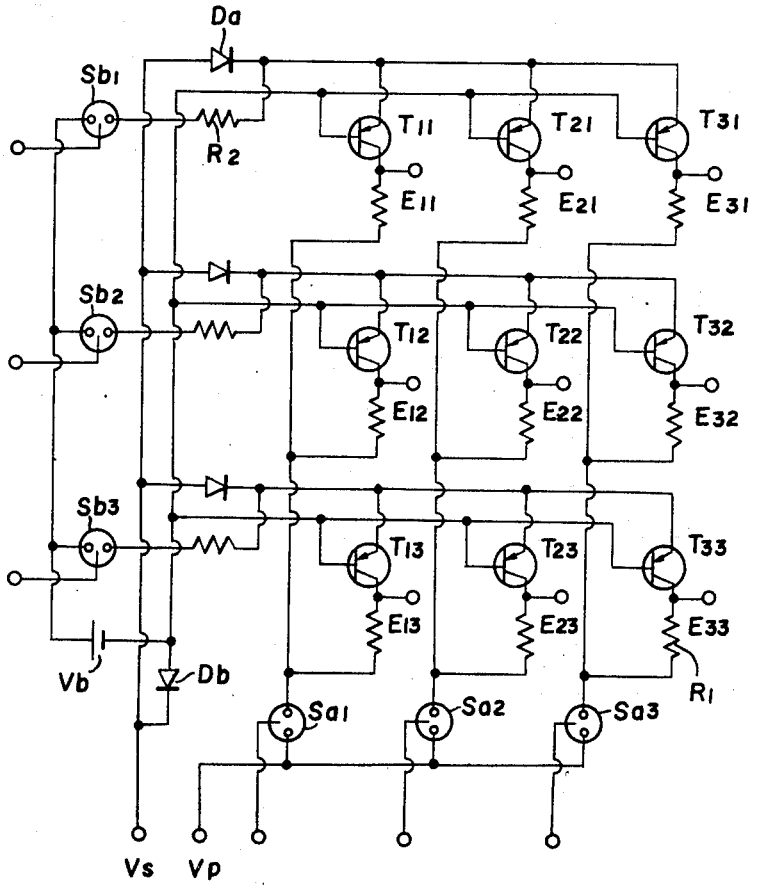

FIG. 6 is a circuit diagram of still another preferred embodiment of the display panel drive circuit of the AC drive discharge type display apparatus of the present invention. The drive circuit is to be used for driving the Y electrodes of the display panel, and the transistor $T_{ij}$ is of the PNP type transistor. The operation of the drive circuit will be described below as follows. In this circuit, the first selective switch circuit $S_{ai}$ is usually in the OFF state, and the second selective switch circuit $S_{bj}$ is usually in the ON state. In this state, the sustaining drive voltage $6_b$ (FIG. 2*c*) is applied to the sustaining drive voltage terminal $V_s$. When the positive voltage $V_s$ is applied to the terminal $V_s$ then the same is applied through the diode $D_a$ to the emitter electrode of the transistor $T_{ij}$. On the other hand, since the selective switch circuit $S_{bj}$ is in the ON state, the bias voltage is applied by the bias power source $V_b$ through the resistance $R_2$ between the base-emitter electrode of the transistor $T_{ij}$ in the forward direction to the base-emitter junction, whereby the transistor $T_{ij}$ is in the ON state.

Accordingly, the positive voltage $V_s$ which is substantially equal to the emitter voltage is applied to the output terminal $E_{ij}$ connected to the Y electrode of the display panel, that is the collector electrode of the transistor $T_{ij}$, by the positive voltage applied to the emitter electrode of the transistor $T_{ij}$.

When the terminal $V_s$ becomes of a zero voltage, the zero voltage is applied through the diode $D_b$ to the base electrode of the transistor $T_{ij}$ whereby the bias in the forward direction is applied between the collector-base of the transistor $T_{ij}$ and the voltage at the output terminal $E_{ij}$, that is the collector electrode of the transistor $T_{ij}$ is substantially equal to the zero voltage.

A drive waveform having a substantially equal level and pulse width to that of the sustaining drive voltage applied to the terminal $V_s$ is applied to the output terminal $E_{ij}$ which is connected to the collector electrode of the transistor, that is the Y electrode which is connected to it, when the first selective switch circuit $S_{ai}$ is in the ON state and the sustaining drive voltage $6_b$ (FIG. 2c) is applied to the sustaining drive voltage terminal $V_s$. The operation of applying the turn-on pulse to only the output terminal $E_{22}$ will now be explained.

In this case, similar to FIG. 4, only the switch $S_{a2}$ in the first selective switch circuit $S_{ai}$ is in the ON state, the collector electrode of the transistor $T_{2j}$ is connected through the resistance $R_1$ to turn on voltage terminal $V_p$ to which the turn-on pulse $7_b$ (FIG. 2c) is applied as an input. On the other hand, only the switch $S_{b2}$ in the second selective switch $S_{bj}$ is in the OFF state, whereby the transistors $T_{2j}$ in the transverse line are in the OFF state.

Accordingly, the turn-on pulse $7_b$ is applied only to the output terminal $E_{22}$ similar to the embodiment of FIG. 4. In the same manner, it is possible to apply the turn-on pulse $7_b$ to a desired output terminal $E_{ij}$ by selectively driving the first selective switch circuit $S_{ai}$ and the second selective switch circuit $S_{bi}$. The operation of applying and turn-off pulse $9_b$ (FIG. 2c) is similar to that of the turn-on pulse. In the embodiments of FIGS. 4, 5 and 6, it should be understood that the bias current is usually passed by the bias power source $V_b$ in the forward direction to the base-emitter junction of the transistor $T_{ij}$ in order to usually maintain the transistors $T_{ij}$ in the ON state.

However, the period of time for maintaining the transistors $T_{ij}$ in the ON state, can only be during the time period wherein the sustaining voltage is discharged to the sustaining drive voltage terminal $V_s$ in the drive circuit using the NPN type transistors or the positive sustaining voltage is applied to the output terminal E in the drive circuit using the PNP type transistors and the turn-on pulse or the turn-off pulse are applied. Accordingly, it is possible to minimize the time period for passing the bias current by controlling to be in the ON state only during said period by connecting the bias power source in series to the switch circuit, or by controlling switch circuit $S_{bi}$ in the ON state only during said period in the embodiment of FIG. 4 or FIG. 6. In this case, the consumption power of the bias source $V_b$ can be advantageously decreased.

When the pulse voltage controlled to have a pulse width and level equal to that of the turn-on pulse 7 is applied to the turn-on voltage terminal $V_p$, the maximum value of the width of the turn-on pulse is decided and the stability of the drive circuit is improved.

Figure 7:
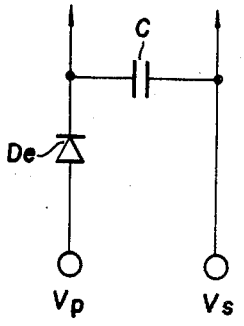
FIG. 7 is a circuit diagram of one embodiment of an input circuit of the drive circuits shown in FIGS. 4–6.

FIG. 7 is a circuit diagram of one embodiment of the input circuit of the turn-on or turn-off voltage in the drive circuits of FIGS. 4, 5 and 6. As shown in FIG. 7, the turn-on pulse is applied as an input through a diode $D_e$ to the turn-on voltage terminal $V_p$, and is added to the sustaining drive voltage 6 (FIG. 2a) by the capacitor C, whereby the voltage of the turn-on pulse applied to the turn-on voltage terminal $V_p$ can be a low voltage provided by substracting the sustaining drive voltage Thus, the direction of the diode $D_e$ has been explained for the case of applying the positive voltage to the turn-on voltage terminal $V_p$. When a negative voltage is applied, the direction of the connection is reversed to that of FIG. 7. The input of the turn-off voltage can be given in the same manner. In the embodiment wherein a short-circuit is connected between the base-emitter of the transistor $T_{ij}$ by the selective switch circuit $S_{bj}$ as shown in FIG. 5 an NPN type transistor is used. However, in the case where a PNP type transistor is used as the transistor $T_{ij}$, it is possible to connect the short-circuit between the base-emitter of the transistor.

As it is now clear from the description, the present invention is to provide an AC drive discharge type display apparatus having a smaller number of circuit elements yet imparts the same function as that of the conventional apparatus which has many circuit elements.

Obviously numerous modifications and variations of the present invention are possible in light of the above teachings. It is therefore to be understood that within the scope of the appended claims the invention may be practiced otherwise than as specifically described herein.

What is claimed as new and desired to be secured by letters patent is:

1. An AC drive discharge type display apparatus which comprises:

a display panel for housing groups of traverse electrodes and vertical electrodes positioned in cross form with a gap therebetween, cross points of the groups of traverse electrodes and vertical electrodes being made luminescent by applying a turn-on signal and being turned-off by applying a turn-off signal;

a plurality of transistors disposed in a matrix, the collectors of the transistors being connected to corresponding electrodes of the display panel;

means for commonly connecting the base of the transistor in each traverse line of the matrix to a sustaining drive voltage source;

means for commonly connecting the emitters of the transistors in each traverse line of the matrix;

means for commonly connecting through resistances the collectors of the transistors in each vertical line of the matrix;

a first selective switch means for applying the turn-on signal or the turn-off signal to the means for commonly connecting the collectors of the specific vertical line of the matrix and a second selective switch means for turning-on the transistor through the means for commonly connecting the emitter and the means for commonly connecting the base of a traverse line other than the specific one, by applying forward bias voltage across the base-emitter of the transistor of the traverse line other than the specific one, whereby the turn-on signal or the turn-off signal is applied through the collector of the transistor disposed at the cross point of the specific vertical line selected by the first selective switch means and the specific traverse line selected by the second selective switch means, to the electrode of the display panel connected to the collector to make the cross point luminescent and nonluminescent.

2. An AC drive discharge type display apparatus according to claim 1, which comprises a circuit for discharging the charge of the electrodes of the display panel between the commonly connected emitters of the transistors in each traverse line of the matrix and the sustaining drive voltage source when the instantaneous value of the sustaining voltage equals zero voltage.

* * * * *